US006958703B2

(12) United States Patent
Aiello

(10) Patent No.: US 6,958,703 B2
(45) Date of Patent: Oct. 25, 2005

(54) DRILL STRING ENABLING INFORMATION TO BE TRANSMITTED

(75) Inventor: Giovanni Aiello, Nanterre (FR)

(73) Assignee: Compagnie du Sol, Nanterre (FR)

( * ) Notice: Subject to any disclaimer, the term of this patent is extended or adjusted under 35 U.S.C. 154(b) by 603 days.

(21) Appl. No.: 10/056,809

(22) Filed: Jan. 24, 2002

(65) Prior Publication Data

US 2002/0105334 A1 Aug. 8, 2002

(30) Foreign Application Priority Data

Jan. 26, 2001 (FR) ..... 01 01067

(51) Int. Cl.[7] ..... G01V 3/00
(52) U.S. Cl. ..... 340/854.3; 367/83
(58) Field of Search ..... 340/854.3, 854.8, 340/855.1, 854.4; 367/82, 83; 324/347

(56) References Cited

U.S. PATENT DOCUMENTS 3,518,609 A * 6/1970 Fontenot, Jr. ..... 439/191
3,866,678 A * 2/1975 Jeter ..... 340/854.3
4,095,865 A * 6/1978 Denison et al. ..... 439/191
4,483,393 A * 11/1984 More et al. ..... 166/65.1
4,496,203 A * 1/1985 Meadows ..... 439/194
4,575,681 A * 3/1986 Grosso et al. ..... 324/347
4,578,675 A 3/1986 MacLeod ..... 340/855

FOREIGN PATENT DOCUMENTS

| | | | |
|---|---|---|---|
| EP | 0 295 178 | 6/1988 | ..... E21B/47/12 |
| EP | 0 964 134 | 6/1999 | ..... E21B/47/12 |
| FR | 2 777 594 | 4/1998 | ..... E21B/47/12 |

OTHER PUBLICATIONS

International Search Report dated Oct. 12, 2001 (in French).

* cited by examiner

*Primary Examiner*—Timothy Edwards, Jr.
(74) *Attorney, Agent, or Firm*—Cohen, Pontani, Lieberman & Pavane

(57) ABSTRACT

The present invention relates to a drill string fitted with information transmission means. The hollow rods of conductive material have their inside faces covered in an insulating material. The transmission means comprise a first electrical unit having at least a first annular electrode secured to the insulating inside face of the drill string, said electrode being in electrical contact with the mud contained inside the drill string so as to establish a flow of current in the conductive mud; and a second electrical unit disposed in said borehole, close to the top end of the drill string in order at least to receive the information contained in said electrical current.

6 Claims, 2 Drawing Sheets

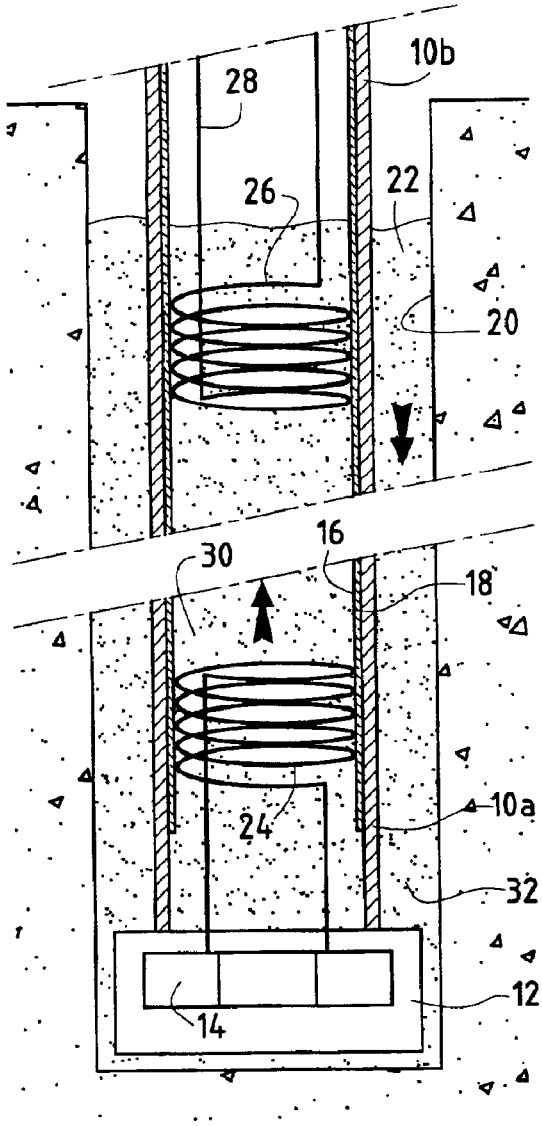
FIG.1
FIG.2
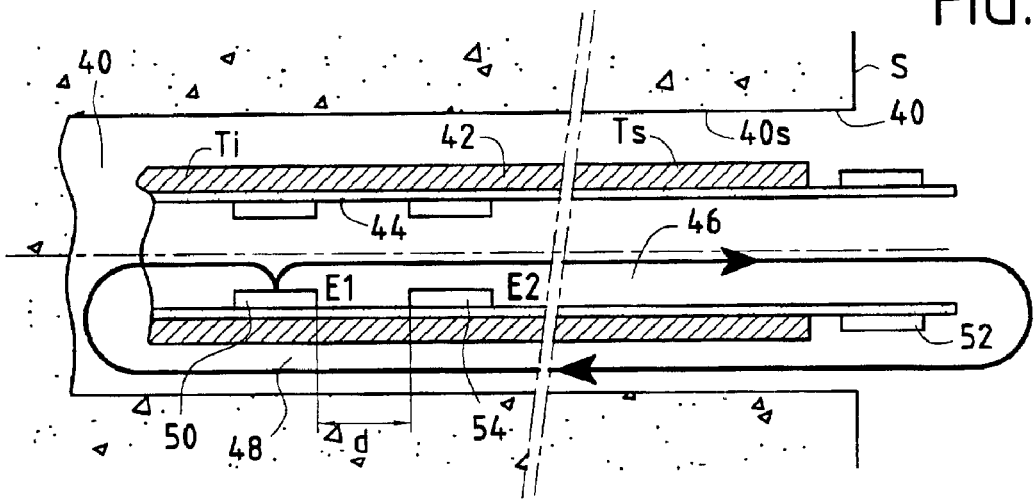

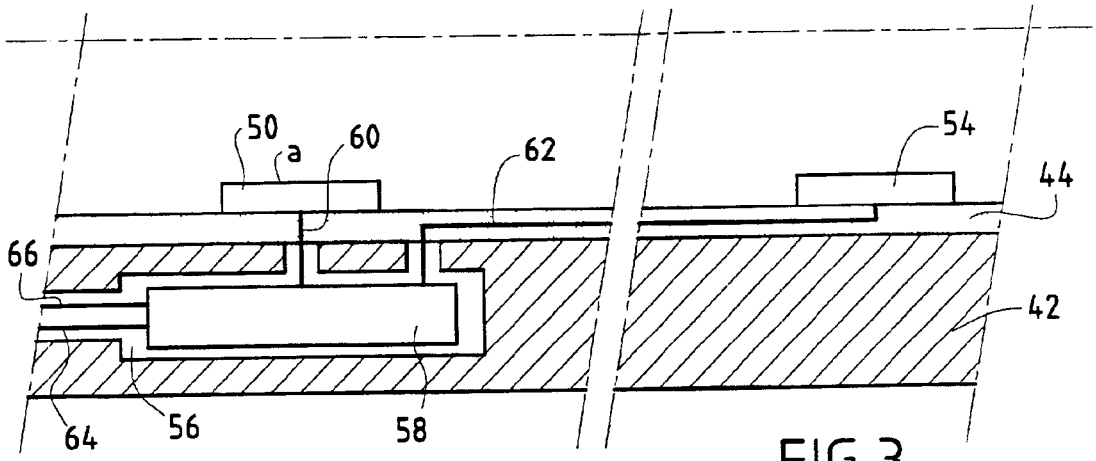
FIG.3
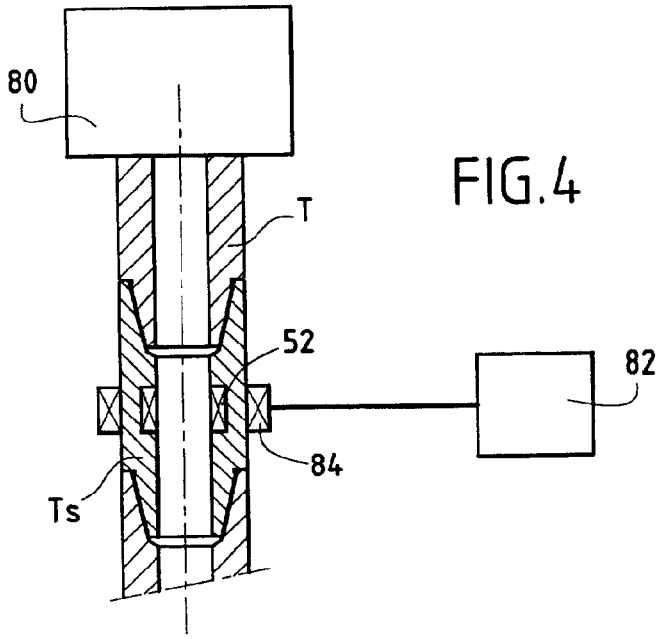
FIG.4
FIG.5
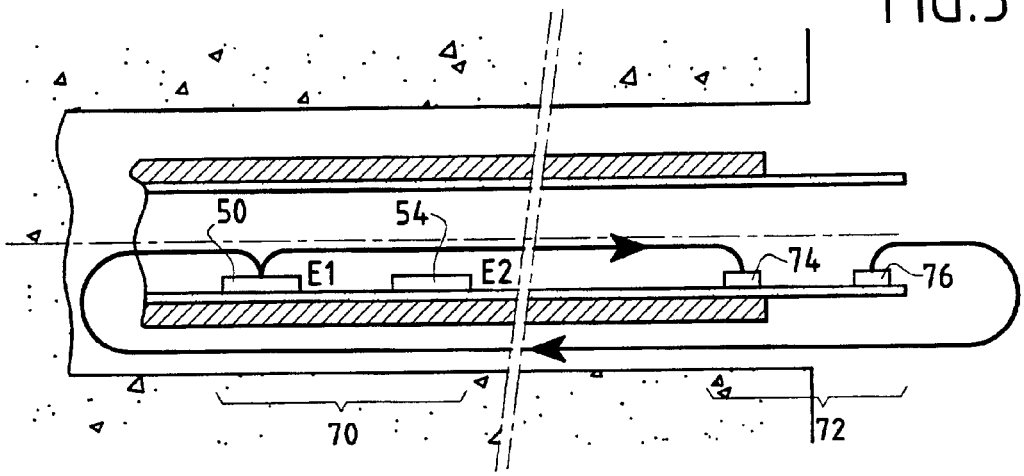

DRILL STRING ENABLING INFORMATION TO BE TRANSMITTED

BACKGROUND OF THE INVENTION

A drilling installation constituted by drill strings enabling information to be transmitted between the bottom of a borehole being drilled and the surface of the ground is already described in French patent 2 777 594 in the name of the Applicant. As explained in that document, while a borehole is being drilled, it is very important to be able to transmit to the surface information that is collected by sensors mounted in the vicinity of the drilling tool, which tool is fixed to the bottom end of the drill string.

One of the solutions proposed in the above-mentioned French patent is described below with reference to accompanying FIG. 1.

FIG. 1 shows a drill string made up of a rod 10*a* constituting the bottom rod, a rod 10*b* constituting the top rod, and intermediate rods. A drilling tool 12 is fixed to the bottom end of the rod 10*a* and has measurement sensors 14. The inside face 16 of the rod 10 is coated in a layer of insulating material 18 over the entire length of the drill string. Furthermore, the drill string is disposed inside a borehole 20 that is being drilled, which borehole is filled with drilling mud 22 that conducts electricity. To enable information to be transmitted, there is a first induction coil 24 disposed close to the bottom end of the rod 10*a* and connected to the measurement sensor 14. There is also an inductive coupler coil 26 mounted inside the top rod 10*b* and connected to conductors such as 28 for transmitting electrical signals picked up by the coil 26 to a processor device.

Because of the presence of the insulating layer 16, a closed current loop is established constituted firstly through the drilling mud 30 filling the inside of the rod 10 and secondly through the assembly constituted by the wall of the rod 10 and by the mud 32 outside the rod 10.

Using the bottom coil 24, alternating current (AC) representing information is induced in the current loop, with this AC being picked up by the receiver coil 26.

Such a installation for transmitting information via a drill string gives satisfactory results in some situations. Nevertheless, it will be understood that information is transmitted via two electromagnetic couplings corresponding to the two coils or toruses which are disposed respectively close to the top end of the drill string and close to its bottom end carrying the tool. These two couplings, constituting current transformers, present the particular characteristic of comprising a very large number of turns wound on toruses. In contrast, the other element of the coupling is constituted by a single turn and consists in the single current loop established essentially via the mud contained in the drill string. Electromagnetic coupling of that type is not optimal and its efficiency or effectiveness can turn out to be insufficient, particularly when the electrical conductivity of the mud is low.

OBJECTS AND SUMMARY OF THE INVENTION

An object of the present invention is to provide a drill string of the above-mentioned type which is fitted with means for transmitting information between the bottom of the borehole in which the equipment is to be found and the ground surface, which drill string enables information transmission to be improved, particularly at the interface between the transmitter or receiver and the mud used for conveying the information.

According to the invention, this object is achieved by a drill string fitted with information transmission means comprising:

a plurality of hollow rods made of conductive material, the inside faces of said rods being covered in insulating material;

a drilling tool secured to the bottom rod of the drill string, said drill string being disposed in part in a borehole filled with an electrically conductive mud, said mud inside the drill string and the mud outside the drill string together with the drill string itself forming a closed loop that conducts electricity;

a first electrical unit placed close to the bottom end of the drill string, in order at least to create in said loop an electrical current representative of information to be transmitted; and a second electrical unit placed in said borehole, close to the top end of the drill string, in order at least to receive the information contained in said electrical current.

The drill string is characterized in that said first electrical unit comprises at least a first annular electrode secured to the insulating inside face of the drill string, said electrode being in electrical contact with the mud contained inside the drill string; and means for applying to said electrode a voltage that is representative of said information to be transmitted.

It will be understood that according to the invention the information for transmission is applied in the form of a voltage to the annular transmitter electrode disposed at the bottom end of the drill string. Relative to ground, this voltage induces current in the above-defined closed current loop, said current being modulated as a function of the information to be transmitted. Reception at the top end of the drill string can be performed as in the above-mentioned state of the art by means of an electromagnetic coupling coil placed inside the drill string, said coil surrounding the mud contained in the drill string, which mud conveys the current.

A second solution of the invention consists in placing two conductive electrodes that are axially offset on the insulating inside face of a rod located close to the top end of the drill string. The potential difference which appears between the two electrodes is created by the current flowing in the current loop. This potential difference is thus itself modulated in the same manner as the current, as a function of the received information.

In a more complete version, the electrical unit placed at the bottom end of the drill string and the electrical unit placed at the top end of the drill string can both be constituted by two conductive electrodes mounted inside the insulating inside face of the rods. Alternatively, one of the electrodes can be used as a transmitter for transmitting information and both electrodes can serve in alternation as receivers of the information that is to be transmitted.

BRIEF DESCRIPTION OF THE DRAWINGS

Other characteristics and advantages of the invention will appear better on reading the following description of various embodiments of the invention given as non-limiting examples. The description refers to the accompanying drawings, in which:

FIG. 1, described above, is a simplified vertical section view through a drill string fitted with prior art information transmission means;

FIG. 2 is a simplified longitudinal section view of a drill string fitted with information transmission means constituting a first embodiment of the invention;

FIG. 3 is a detail view of FIG. 2 showing the means for transmitting and for receiving information;

FIG. 4 is a simplified view of the top portion of the drill string in the first embodiment as shown in FIG. 2; and FIG. 5 is a view analogous to FIG. 2, showing a second embodiment of the invention.

MORE DETAILED DESCRIPTION

With reference initially to FIG. 2, there follows a description of a first embodiment of the drill string that enables information to be transmitted.

FIG. 2 is a simplified diagram of a borehole 40 while it is being bored. This borehole contains a drill string and, more particularly, the bottom rod $T_i$ having the drilling tool mounted thereon (not shown in the figure) and the top rod $T_s$. Intermediate rods are naturally interposed between these two end rods. Each rod is constituted by a conductive metal wall 42 having its inside face covered in an insulating layer 44.

As already explained, the borehole 40 is filled with a mud that conducts electricity more or less well and that fills not only the inside 46 of the drill string, but also the annular space 48 between the drill string and the wall of the borehole 40. This establishes a closed conductive loop constituted firstly by the mud on the inside 46 and secondly by the conductive wall 42 together with the mud in the outer annular space 48. These two branches of the electrically conductive circuit are separated by the insulating layer 44 and they are interconnected at the bottom by the tool itself and at the top by appropriate means. In this figure, reference 40F designates the borehole and 40S the top end of the borehole close to the surface of the ground S.

According to an essential characteristic of the invention, the bottom electrical unit is constituted by an electrode, preferably an annular electrode 50, which is fixed by any suitable means to the insulating wall 44 of the rod $T_i$. This electrode is in direct electrical contact with the mud 46 contained inside the drill string. The electrode is preferably disposed at a sufficient distance from the drilling tool. Similarly, at the top end of the drill string, there can be seen an electromagnetic coupling coil 52. It will be understood that in order to transmit information from the bottom of the borehole close to the tool towards the top portion of the borehole, i.e. towards the surface of the ground, a modulated electrical voltage is applied to the electrode 50, with the modulation corresponding to the information that is to be transmitted. This electrical voltage sets up a modulated electrical current in the zone 46 which flows around the above-defined current loop. This current passes in particular through the zone surrounded by the electromagnetic coil 52. The flow of this modulated current causes an electrical voltage to appear at the terminals of the coil 52, which voltage is representative of the information transmitted by the electrode 50. It will be understood that this avoids the above-mentioned problems concerning transmission and corresponding to poor electromagnetic coupling between the current loop and the coil as provided in the prior art for sending the information. However, such poor quality coupling is less unfavorable when it comes to reception by the electromagnetic coil 52.

In some cases, it is useful to transmit information not only from the bottom of the borehole to the surface of the ground, but also from the surface of the ground down to the bottom of the borehole, e.g. to send information to actuators of the drilling tool. To achieve this result, a second annular electrode 54 is provided in the bottom rod $T_i$ where it is fixed to the insulating wall 44 of the rod. The electrode 54 is offset axially by a distance d relative to the transmitting electrode 50. When AC is applied to the coil 52, this induces current in the mud 46 which is modulated in the same manner and which flows around the above-defined current loop. This circulating current establishes a potential difference between the electrodes 50 and 54, which potential difference can be picked up and presents the same modulation as the current initially applied to the coil 52. By measuring the modulation of the potential difference between the electrodes 50 and 54, it is possible at the bottom of the borehole to pick up information transmitted by the coil 52.

Reference is now made to FIG. 3 in order to describe in greater detail the bottom electrical unit that is used for transmitting and receiving information. This figure shows the electrodes 50 and 54 fixed to the insulating wall 44 of the conductive wall 42 of the drilling rod. A cavity 56 or the like substantially in register with the electrode can be defined by any suitable means in the wall 42 of the rod or in a piece fitted to the rod. Various electrical or electronic components given overall reference 58 are mounted in the cavity 56. These components are connected by electrical conductors 60 and 62 to the electrodes 50 and 54. These components 58 are also connected via a set of electrodes 64 and 66 both to the sensors disposed in the tool and also to the actuators mounted in said tool, if any.

During a transmission stage, i.e. when measurements made by the tool sensors are to be transmitted to the surface of the ground, the circuit 58 receives encoded information for transmission and they generate a corresponding electrical voltage for application to the transmission electrode 50, thereby injecting modulated current into the closed conductive loop.

During a reception stage, the circuits 58 are connected simultaneously to both electrodes 50 and 54. The circuits 58 have means for measuring the potential difference between the voltages picked up by the electrodes 50 and 54. This potential difference carries modulation corresponding to the received information which can be encoded or forwarded in suitable manner by the circuits 58 for application to actuators of the tool via the electrical connection 66.

FIG. 4 shows the top portion of the drill string including the rod $T_s$ fitted with its coil 52, a standard rod T which is engaged in the drilling head 80 for controlling rotation of the drill string and downward drive thereof. In order to connect the receiver coil 52 to the processor unit 82 disposed on the surface of the ground, a rotary collector 84 is provided surrounding the rod T and electrically connected to the processor unit 84.

In the embodiment of FIG. 5, the bottom electrical unit referenced 70 is constituted essentially by the electrodes 50 and 54 as already described with reference to FIGS. 2 and 3. The top electrical unit, referenced 72 and disposed close to the ground surface is likewise constituted by two annular electrodes 74 and 76 substantially identical to the electrodes 50 and 54 and fixed to the insulating lining 44 of the top drilling rods $T_s$. The electrode 74 is used solely for sending information from the surface in the same manner as the transmission electrode 50 is used. In contrast, in order to receive information transmitted from down the borehole, both electrodes 74 and 76 are used. The modulated potential difference picked up between these two electrodes as created by the flow of the modulated current as produced by the bottom electrical unit 70 constitutes received information which is representative of the information transmitted by the bottom electrical unit 70.

In the figures, the annular electrodes are represented as projecting relative to the insulating layer 44. Preferably, the insulating layer 44 is of sufficient thickness to make it possible for the inside faces a of the electrodes to be flush with the inside face of the insulating layer. Nevertheless, it is necessary for the thickness of the portion of the insulating layer between the electrode and the wall of the rod to be sufficient to provide the desired degree of electrical insulation. This avoids creating head losses in the rod.

Also preferably, the annular electrode is made out of a material that is a good conductor of electricity, e.g. brass, having its inside surface treated, e.g. by nitriding, so as to give this surface sufficient hardness to enable it to withstand the abrasive effect of the liquid circulating in the rod.

The width l of the electrodes in the axial direction of the rod is preferably greater than or equal to 2D, where D is the inside diameter of the duct.

When the system is designed to operate as a receiver also, it is advantageous for the distance d between the two electrodes to be as great as possible. However, this distance is limited since, for manifest practical reasons, it is necessary for the two electrodes to be mounted on the same rod of the drill string. This distance therefore depends on the length of the bottom rod $T_i$ and on the length of the top rod $T_s$.

Finally, tests have been performed which show that good signal transmission is obtained even for a drill string that is 80 meters long, when using an alternating electrical signal at 10 volts delivering about 50 milliamps.

What is claimed is:

1. A drill string fitted with information transmission means, the string comprising:

a plurality of hollow rods made of conductive material, the inside faces of said rods being covered in insulating material;

a drilling tool secured to the bottom rod of the drill string, said drill string being disposed in part in a borehole filled with an electrically conductive mud, said mud inside the drill string and the conductive mud outside the drill string together with the drill string itself forming an electrically conductive loop;

a first electrical unit disposed close to the bottom end of the drill string having at least a first annular electrode secured to the insulating inside face of the drill string, said electrode being electrically in contact with the mud contained inside the drill string, in order at least to create an electrical current in said loop that is representative of information to be transmitted;

a second electrical unit disposed in said borehole, close to the top end of the drill string, in order at least to receive the information contained in said electrical current, said second electrical unit having second and third annular electrodes fixed to the insulating inside wall of the drill string and in electrical contact with the mud contained in said drill string, said second and third electrodes being axially offset, and accompanied by means for picking up the potential difference created between said second and third electrodes; and means for applying a voltage to said electrode, which voltage is representative of the information to be transmitted.

2. A drill string according to claim 1, in which said second electrical unit is constituted by an electromagnetic coupling coil mounted inside said drill string and surrounding the mud inside the drill string, and by means for picking up the electrical voltage developed across the terminals of said coil by the flow of said electrical current.

3. A drill string according to claim 1, for transmitting information in both directions between said first and second electrical units, in which said first electrical unit further comprises a fourth annular electrode secured to the insulating inside wall of the drill string and in electrical contact with the mud contained in said drill string, being axially offset relative to the first electrode, and means for picking up the voltage which appears between said first and fourth electrodes in response to the electrical current flowing in said current loop as created by said second electrical unit.

4. A drill string according to claim 1, for transmitting information in both directions between said first and second electrical units, in which said first electrical unit further comprises a fourth electrode secured to the insulating inside wall of the drill string and in electrical contact with the mud contained in said drill string, being axially offset from the first electrode, and means for picking up the voltage which appears between said first and fourth electrodes in response to an electrical current flowing in said current loop as created by said second electrical unit, and in which said second electrical unit comprises means for applying to said second electrode a voltage that is representative of information for transmission from said second electrical unit to the first electrical unit.

5. A drill string according to claim 1, in which each annular electrode is disposed in the insulating material in such a manner that the inside face of each electrode is flush with the inside face of the insulating material.

6. A drill string according to claim 1, in which each electrode has an inside face that withstands abrasion.

* * * * *